United States Patent [19]

Slater et al.

[11] 4,039,193

[45] Aug. 2, 1977

[54] GAME AND APPARATUS THEREFOR

[76] Inventors: Margaret Anne Slater; William Clarence Slater, both of 2724 Harvie Road, Richmond, Va. 23223

[21] Appl. No.: 713,247

[22] Filed: Aug. 10, 1976

[51] Int. Cl.[2] ..... A63F 5/04

[52] U.S. Cl. ..... 273/138 R; 273/120 R

[58] Field of Search ..... 273/142 H, 142 R, 142 C, 273/142 A, 142 B, 142 D, 142 E, 142 F, 142 G, 142 HA, 142 J, 142 JA, 142 JB, 142 JC, 142 JD, 142 K, 138 R, 138 A, 139, 144 R, 144 A, 145 B, 96 R, 120 R, 120 A, 105 R, 108, 109, 113, 115, 116, 117, 119 R, 123 R, 86 C; 46/43

[56] References Cited

U.S. PATENT DOCUMENTS

| | | | |
|---|---|---|---|
| 87,410 | 3/1869 | Hauschild | 273/120 R |
| 201,398 | 3/1878 | Eusten | 273/138 R |
| 474,102 | 5/1892 | Shuman | 273/120 R |
| 541,991 | 7/1895 | Clawson | 273/142 H X |
| 675,478 | 6/1901 | Harkrider | 273/120 R |
| 772,281 | 10/1904 | Jurado | 273/120 R |
| 809,853 | 1/1906 | Silvernail | 273/123 R |
| 1,176,033 | 3/1916 | Collins | 273/120 R |
| 2,607,592 | 8/1952 | Finnerty | 273/138 R X |
| 3,674,275 | 7/1972 | Samson | 273/138 R |
| 3,989,252 | 11/1976 | Mattson | 273/138 R |

FOREIGN PATENT DOCUMENTS

| | | | |
|---|---|---|---|
| 333,469 | 2/1921 | Germany | 273/120 R |
| 487,931 | 12/1929 | Germany | 273/120 R |
| 533,753 | 9/1931 | Germany | 273/120 R |
| 570,347 | 2/1933 | Germany | 273/142 D |

*Primary Examiner*—Richard C. Pinkham
*Assistant Examiner*—Arnold W. Kramer
*Attorney, Agent, or Firm*—Norman B. Rainer

[57] ABSTRACT

An apparatus is provided comprising a plurality of horizontally mounted circular rotatable platforms, each containing a multitude of depressions and associated indicia to facilitate visual differentration amongst said depressions, a distributor means positioned above said platforms and containing a plurality of guide channels, each communicating with a depending chute, the number of chutes corresponding to the number of said platforms, the lower end of each chute terminating above an associated platform.

In playing a game utilizing said apparatus, a ball is entered into said distributor means, whereupon it is randomly routed to a depression in one of the platforms, said depression representing a means for scoring in a game played by two or more persons.

8 Claims, 4 Drawing Figures

GAME AND APPARATUS THEREFOR

BACKGROUND OF THE INVENTION

This invention relates to an amusement apparatus and its manner of use, and more particularly to an amusement device which may be used in playing games of chance.

It is an object of the present invention to provide an amusement apparatus which may be utilized simultaneously by two or more persons playing a game of chance. It is another object of this invention to provide an apparatus of durable construction and simple operation which may be safely used by children as a toy or amusement device. A further object is to provide a game of chance comprising an apparatus and its manner of use, said game of chance being playable by two or more persons at the same time. It is still another object of the present invention to provide a gambling apparatus useable by two or more persons simultaneously, wherein each player can separately manipulate a moving part which may affect the outcome of the game. Other objects and advantages will become apparent hereinafter.

SUMMARY OF THE INVENTION

The apparatus of this invention comprises stationary horizontally disposed support means, a plurality of identically constructed circular platforms rotatably mounted on said horizontally disposed support means in equally spaced juxtaposition about a generally circular locus, each of said platforms containing in the upper face thereof a multitude of depressions, associated indicia to facilitate visual differentiation amongst said depressions, and an encircling retaining wall projecting above said upper face. A distributor means positioned above said platforms and above the center of said generally circular locus contains a plurality of guide channels, each communicating with a depending chute, the number of which corresponds to the number of said platforms. The lower end of each depending chute terminates above an associated platform. Vertically disposed support means maintains the distributor head and depending chutes in the aforesaid proper position. A conical hollow chamber the apex of which is truncated and directed upwardly, rests atop and encloses said distributor means.

In playing a game utilizing the apparatus of this invention, a spherical ball-shaped rolling object is dropped through the truncated apex of the hollow chamber. It randomly selects a guide channel in said distributor means, advances to and falls through the associated depending chute, and lands on the associated platform which may be rotating. The ball finally comes to rest in one of the depressions in the upper face of said platform. The indicia associated with said depression is noted and utilized for purposes of scoring in a game played by two or more persons, each person assigned to a particular platform.

DETAILED DESCRIPTION OF THE INVENTION

Figure 1:
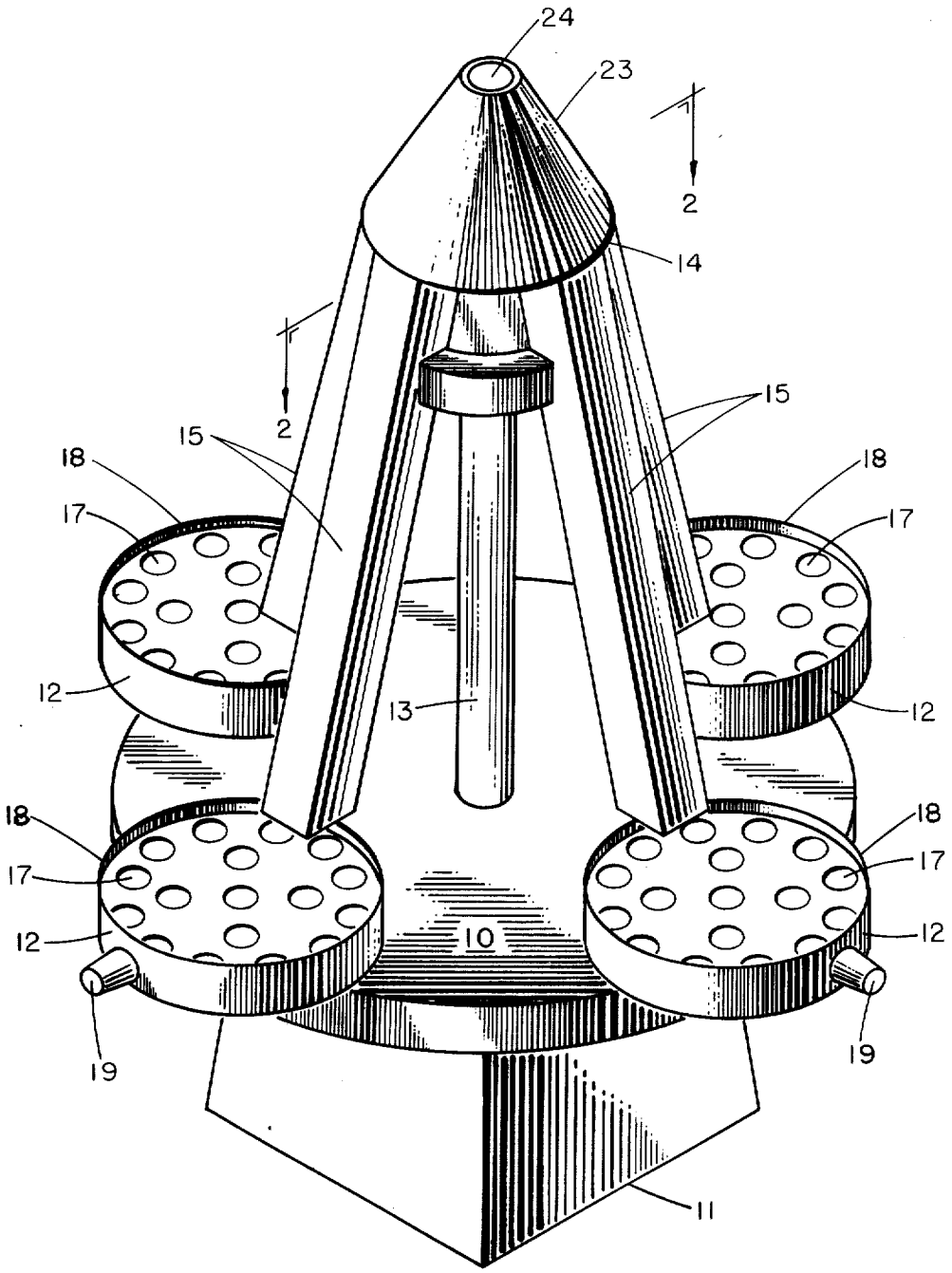
FIG. 1 is a perspective view of the apparatus of this invention.
Figure 2:
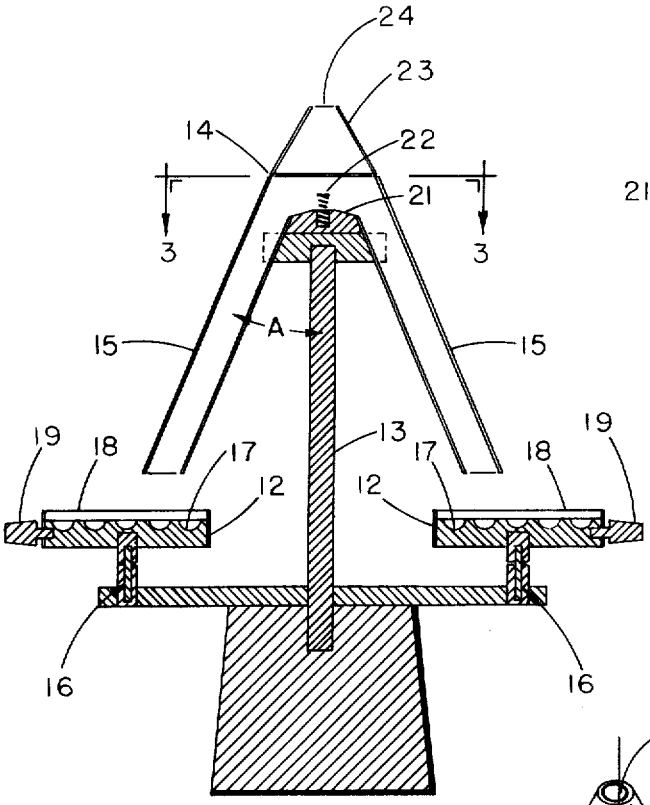
FIG. 2 is a longitudinal section taken along the line 2—2 of FIG. 1.

Referring to FIG. 1, horizontally disposed support means represented by the stationary circular panel 10 mounted on pedestal means such as stand 11 supports the four rotatable circular platforms 12 which are equidistantly spaced in a circular locus about the periphery of panel 10. Vertically disposed support means represented by the rigid post 13, centrally mounted on panel 10 supports a distributor means, exemplified as distributor head 14. Depending chutes 15 emerge from the bottom of distributor head 14 and extend downwardly, terminating at a site close to the upper face of the rotatable platforms and close to the rotational center thereof. Each rotatable platform 12 is pivotably supported at its rotational axis by an axle bearing 16 mounted on panel 10.

Each rotatable platform 12 contains in its upper face a multitude of symetrically spaced depressions 17 which preferably have a circular contour. An encircling retaining wall 18 projects above the upper face of each platform 12 as an extension of the circular periphery of said platforms. A handling means such as knob 19 is situated on the outer edge of each platform 12 to facilitate manual individual rotation of said platforms.

Figure 3:
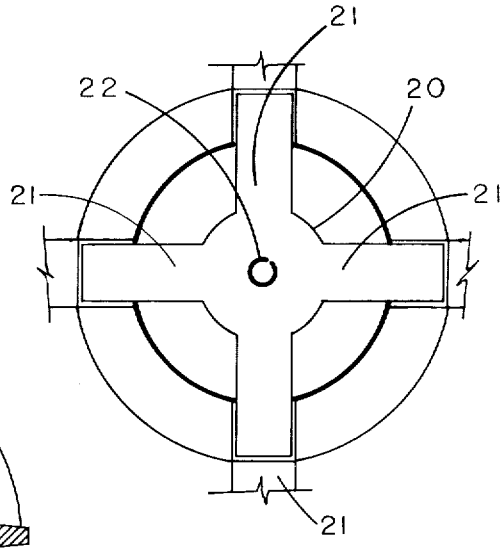
FIG. 3 is a sectional view taken along the line 3—3 of FIG. 2.

The distributor head 14, more clearly shown in FIG. 3, comprises a centrally positioned horizontal surface 20, and emanating therefrom, a number of downwardly angled guide channels 21 which lead to and communicate with the upper open ends of depending chutes 15. The number of guid channels 21 in the illustrated embodiment corresponds to the number of chutes. A resilient deflector 22, consisting of a spring or elastomeric material is axially positioned on the horizontal surface 20. A hollow conical chamber 23, the top of which is truncated to provide a circular opening 24 rests atop and encloses distributor head 14. The center of opening 24 is directly above deflector 22.

The various parts of the apparatus of this invention may be constructed of shapeable rigid materials such as wood, plastics, metals, ceramics, laminates, and combinations thereof. When intended as a children's toy, brightly colored ornamentation and a general appearance suggesting a rocket enhances the appeal and consequent utilization of the apparatus. in a preferred embodiment, the apparatus is designed to be easily dismantled and reassembled to facilitate shipping, and storage when not in use.

In operation, a smooth-surfaced spherical ball object such as a "marble" or ball bearing is dropped through the opening 24 in the top of the conical chamber. The ball strikes deflector 22, enters at random one of the channels 21, proceeds through the associated chute 15, emerges onto the corresponding platform 12, and comes to rest at random in one of the depressions 17. The platform 12 is preferably in rotating motion when it receives the ball.

The apparatus may have four or more rotatable platforms equidistantly spaced in a circular locus about vertical axis 25 perpendicular to the plane of said locus at the center thereof. The platforms are preferably but not necessarily circular, having a diameter or maximum dimension preferably in the range of about 4 to 7 inches. Each platform is preferably manually rotatable at a volocity independent of the rotational motion of the other platforms. In the other embodiments, however, all the platforms may be coupled by means of gears, pulleys or the equivalent so that all may rotate at the same velocity in response to a common drive mechanism. Independently different rotational velocities of the platforms may also be achieved by providing separate manually operable braking means for platforms being rotated by a common drive mechanism. The retaining wall 18 bordering each platform is of sufficient height, generally ½ to 1½ inches, to prevent the ball from bounding off the platform.

The depressions 17 are separately designated in each platform by means of indicia such as printed letters or numerals, colors, shapes of the depression, or combination thereof.

The cross sectional configuration of the chutes may be circular or polygonal, such as the square-sectioned chutes shown in FIG. 1. The downward slope of the chutes may be defined by the angle A measured between the longitudinal center axis of the chute 15 and vertical axis 25. Angle A should have a value between about 10° and 70°, with a preferred range being between 20° and 45°. Although straight chutes are preferred, chutes having curved portions are also contemplated as being within the purview of the present invention.

Figure 4:
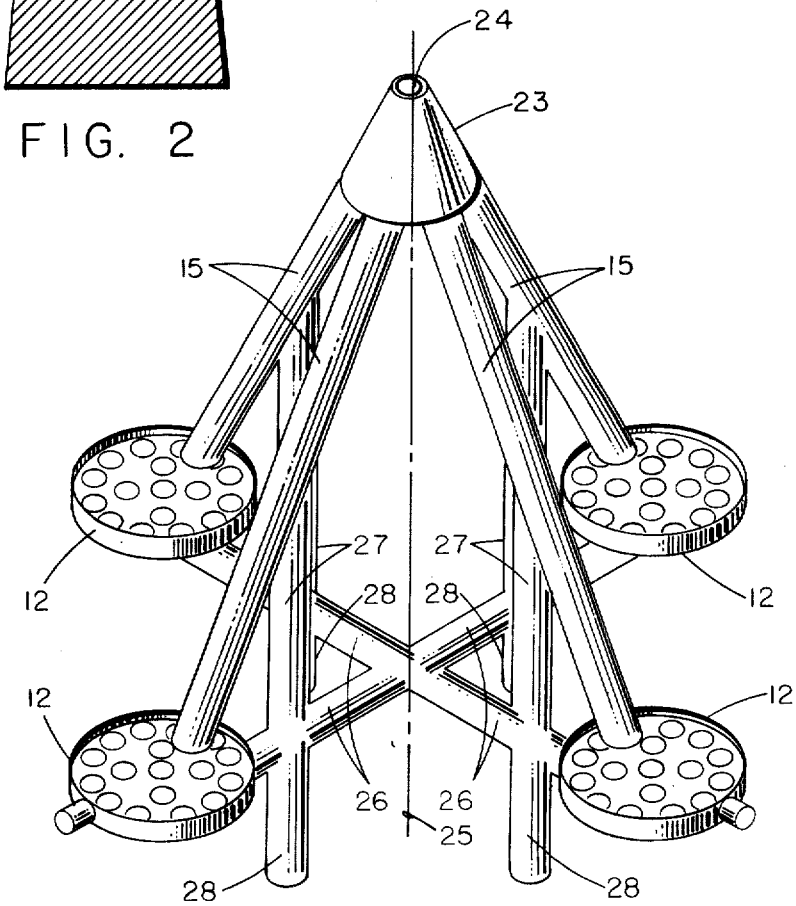
FIG. 4 is a perspective view of another embodiment of the apparatus of this invention.

The horizontally disposed support means may consist of an integral member such as panel 10 of FIG. 1, or may be comprised of structural equivalents such as the horizontally disposed members 26 of FIG. 4, which cross at the center axis 25 and, at their outer extremities support the rotatable platforms 12.

The vertically disposed support means may consist of the post 13 of FIG. 1, or may be comprised of structural equivalents such as the upright members 27 attached to depending chutes 15 and joining with horizontally disposed members 26. Still other alternative equivalent embodiments of both the horizontally and vertically disposed support means will be obvious, with preferred embodiments possessing a symmetry with respect to center axis 25, particularly wherein the axis of hollow chamber 23 coincides with axis 25.

The pedestal means, which functions to place rotating platforms 12 at a convenient height, may consist of the stand 11 of FIG. 1 which may be of square, round or other design, or may be comprised of legs 28 shown in FIG. 4, which represent extensions of the symetrically disposed upright members 27. In still other equivalent embodiments, the pedestal may be integral with either the horizontally or vertically disposed support means.

The overall height of the apparatus, as measured from the bottom of the platforms to the top of the conical chamber, may range from about 10 to 25 inches in the case of embodiments intended as toys. Larger embodiments, intended as gaming apparatus for a number of people, may have overall heights as great as ten feet. Such larger sized embodiments will have more than four rotatable platforms arranged about a table at which players can comfortably sit or stands, and the distributor means may be provided with means for closing off guide channels leading to platforms which are not in use.

In utilizing the apparatus of this invention to play a game, each player operates a different rotatable platform. A ball is dropped through the conical chamber and emerges onto one of the platforms, finally coming to rest in one of the depressions in said platform. By having a certain number of points associated with each depression, a score can be kept, representing the cumulative total of points accured for a number of ball-dropping runs. Some of the depressions may represent negative point values or other penalty features such as forfeiting the next run, or giving points to another player. It is also conceivable that, associated with certain depressions, there may be mechanical or electrical means for activating either a scoring system or a penalty situation for subsequent events at a given platform.

What is claimed is:

1. A game apparatus comprising horizontally disposed support means on which there is rotatably mounted a plurality of identically constructed platforms equally spaced about a generally circular locus, each of said platforms containing on the upper face thereof a multitude of depressions and associated indicia to facilitate visual differentiation amongst said depressions, and an encircling retaining wall projecting above said upper face, a distributor means positioned above the center of said circular locus containing a plurality of guide channels, each communicating with a depending chute whose lower end terminates above an associated platform, vertically disposed support means to maintain said distributor means and chutes in the aforesaid proper positions, and a conical hollow chamber which rests atop and encloses said distributor means, the apex of said chamber being truncated and upwardly directed.

2. The apparatus of claim 1 wherein said chutes are straight and form an angle of between 10° and 70° with the vertical axis of said circular locus.

3. The apparatus of claim 1 wherein the axis of said conical hollow chamber coincides with the vertical axis of said circular locus.

4. The apparatus of claim 1 containing pedestal means positioned underneath said horizontally disposed support means.

5. The apparatus of claim 1 wherein each platform contains handle means to facilitate manual rotation of said platform.

6. Apparatus of claim 1 wherein said guide channels are downwardly angled.

7. Apparatus of claim 1 wherein said distributor means contains a centrally positioned resilient deflector.

8. Apparatus of claim 1 wherein said depressions are of circular contour.

* * * * *